US011266898B2

(12) United States Patent
Rosiak et al.

(10) Patent No.: US 11,266,898 B2
(45) Date of Patent: Mar. 8, 2022

(54) COLLAPSIBLE SKI

(71) Applicant: Renata Rosiak, Meszna (PL)

(72) Inventors: Dariusz Rosiak, Meszna (PL); Joanna Wesolowska, Meszna (PL)

(73) Assignee: Renata Rosiak, Meszna (PL)

( * ) Notice: Subject to any disclaimer, the term of this patent is extended or adjusted under 35 U.S.C. 154(b) by 0 days.

(21) Appl. No.: 16/965,043

(22) PCT Filed: Jan. 25, 2019

(86) PCT No.: PCT/PL2019/050005

§ 371 (c)(1),
(2) Date: Jul. 27, 2020

(87) PCT Pub. No.: WO2019/147151

PCT Pub. Date: Aug. 1, 2019

(65) Prior Publication Data

US 2021/0106902 A1 Apr. 15, 2021

(30) Foreign Application Priority Data

Jan. 26, 2018 (PL) ..... 424384

(51) Int. Cl.
*A63C 5/02* (2006.01)

(52) U.S. Cl.
CPC ..... *A63C 5/02* (2013.01)

(58) Field of Classification Search
CPC ..... A63C 5/02
See application file for complete search history.

(56) References Cited

U.S. PATENT DOCUMENTS

| | | | | | |
|---|---|---|---|---|---|
| 3,797,838 | A * | 3/1974 | Shurgot | ..... | A63C 5/02 280/603 |
| 4,155,568 | A * | 5/1979 | Galich | ..... | A63C 5/02 280/603 |
| 4,248,449 | A * | 2/1981 | Wilhelmy | ..... | A63C 5/02 280/603 |
| 4,405,150 | A * | 9/1983 | Esper | ..... | A63C 5/02 280/603 |

(Continued)

FOREIGN PATENT DOCUMENTS

| | | | | |
|---|---|---|---|---|
| DE | 3816154 A1 * | 11/1989 | ..... | A63C 5/02 |
| EP | 2999525 | 3/2016 | | |
| GB | 1405293 | 9/1975 | | |

(Continued)

*Primary Examiner* — James A Shriver, II
*Assistant Examiner* — Michael T. Walsh

(57) ABSTRACT

A collapsible ski comprising two structural portions, that is the front and the rear of the ski, coupled together by provisions of a tenon formed in the rear portion of the ski along the entire width from the edge to the edge corresponding to a mortise formed on an entire width of the front portion of the ski wherein the mortise comprises a pair of arms. The ski comprises a ski binding consisting of a front part and a rear part, wherein the ski binding comprises a plate coupled to the rear portion of the ski via screws and a transversal bar sandwiched between the plate and the ski. The coupling of the ski is positioned in a location enabling attachments of the front of the ski binding onto the rear portion of the ski. The ski further comprises a latch located in a long axis of the ski.

4 Claims, 6 Drawing Sheets

(56) References Cited

U.S. PATENT DOCUMENTS

Figure 1:
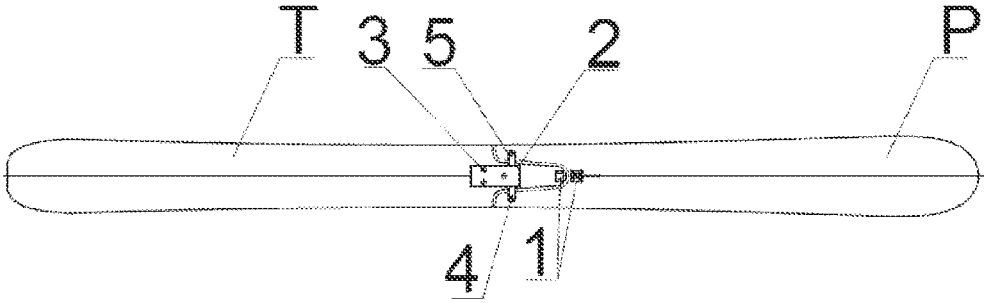

| | | | | | |
|---|---|---|---|---|---|
| 2008/0246236 | A1* | 10/2008 | Lombano | ..... | A63C 5/03<br>280/18 |

FOREIGN PATENT DOCUMENTS

| | | | | | |
|---|---|---|---|---|---|
| GB | 1405293 | A * | 9/1975 | ..... | A63C 5/02 |
| GB | 1527241 | | 10/1978 | | |
| WO | WO-8501883 | A1 * | 5/1985 | ..... | A63C 5/02 |
| WO | 2010109157 | | 9/2010 | | |
| WO | WO-2010109157 | A1 * | 9/2010 | ..... | A63C 5/02 |

* cited by examiner

COLLAPSIBLE SKI

The subject of the invention is a ski collapsible for transportation with a cascade coupling in a shape of a letter omega.

From the American patent description U.S. Pat. No. 4,405,150 is known a collapsible ski, which in a functional assembled state and when ready to use, like any other ski, comprises a frontface with a tip bowed upwardly against the ground, a rear face with so called tail which is either flat or slightly bent upwardly against the ground, as well as a central area which is located between the front and the rear area and is adapted for mounting of any desirable ski binding. An area, which when in use faces the ground, is provided with a sliding layer and both its longitudinal edges are appropriately strengthened to enable the ski movement by turning on a hard surface. Such a ski basically comprises at least three portions that are interconnected in a removable manner, namely the front portion and the rear portion that are rotatably coupled in the central area of the ski, as well as the cover. The portion that is rotatably coupled with the rear portion and may be located on at least part of the front portion and rear portion of the ski and further mounted in that position when covering the portions. The covering portion is formed as a U profile and is adapted to work with two ribs that are present on the surface of the front portion and the rear portion at least in the central area of the ski, namely in the area involving the leg.

From patent description PL/EP 2999525 is known a collapsible ski, wherein a front portion and a rear portion, when configured in their linearly aligned position, may be mounted in such a position by provisions of a rotary platform.

It is known from patent description GB1405293 a structure of a collapsible ski involving a tenon and mortise. A disadvantage of such solutions is a short line of a ski coupling, that is a line perpendicular to the longitudinal axis of the ski, equal the width of the ski. Because of the ski bending, a great moment of forces is formed distributed on the short line of the coupling. It results in great unit forces delaminating the ski at the couplings.

A similar problem is in a solution known from patent description GB1527241, where a line of coupling of a ski portions equals the width of the ski. Additional problem is a metal pocket in the central portion of the ski, along a significant length of the ski replacing a material suitable for contact with the snow provides good slide. In low temperatures, the snow freezes onto the metal pocket of the ski that shortly becomes icy and hinders or prevents appropriate slide.

It is also known from patent description W02010109157 a collapsible ski involving a tenon and mortise. The ski comprises three portions with coupling lines perpendicular to the axis of the ski. The forces resulting from a bending moment are distributed on part of the ski width, that is the line significantly smaller than the ski width. A complex, precise mechanism joining the portions of the ski is extremely sensitive to soiling that restrains operation of the coupling.

A problem is in manufacturing a ski that a length of arms of joining the segments may be fully adjustable in production, obtaining distribution of delaminating forces—resulted from the bending moment, on a length exceeding by multiples the width of the ski. Thus, the problem is to design a coupling such that the load of the delaminating forces on the coupling line be the least.

A problem is also the fact that to manufacture a collapsible ski it is necessary to introduce modifications and adjustments on a majority of production lines in the existing factories.

The disclosed ski comprises in its assembled, i.e. functional state, a front portion with a tip slightly bowed upwardly against the ground, a rear portion either typically flat or slightly away from a tail upwardly bent against the ground, as well as a central area which is adapted for attachment of a ski binding including a front part and a rear part and is suitable for mounting any ski boot on a top surface. The other, sliding surface, when the ski is in use, faces the ground and is practically entirely limited in length, i.e. it ends in two edges of the ski, and in the state such a ski is assembled and comprises the front portion and the rear portion that are rotatably interconnected around the transverse geometric axis parallel to the sliding surface. The front and rear portion are optionally arranged in a linearly aligned position thereof by provisions of the centres of the coupling platform which is adapted to receive the front part and the rear part of the ski binding to attach any ski boot on the top surface of the ski. The ski is marked at the front and rear portion of the ski, when situated in their linearly aligned position, may be assembled in such a position by means of a platform which may rotate around an axis going onto a fold in between both portions, and the axis is perpendicular against the sliding surface of the ski.

Both described solutions show rotary assembly, comprising more than two structural parts. In the area of the coupling, significant structural modifications are necessary that have an impact on the profile of the ski, whereas in order to integrate the ski and lock the coupling additional structural elements have been used that have an impact on the features of the ski. The ski according to the invention is detachable in the area of its midpoint, before the part where a binding is mounted which front and rear should be mounted onto the rear portion of the ski, cut transversely from the edge to the edge. The cut is in a shape of a letter omega, whereas it is preferable when the cut is of a shape of a cascade connection of omega letters. The entire length of the cut of the front portion of the ski is a mortise for a tenon formed by a line of the cut on the rear portion of the ski. The mortise and tenon are located approximately in the midpoint of the transverse section of the ski. The coupling of the ski is located in the place enabling attachment of the front of the binding on the rear portion of the ski. The arms of the coupling resembling a shape of a letter omega are connected together in order to prevent the arms from moving apart under the influence of the existing forces. In the first embodiment, for the coupling with the omega arms facing the rear of the ski and with the plate underneath the binding, they are joined by a transversal bar attached by the screws to the arms of the coupling and located just before the front part of the binding, whereas a latch/clamp situated in the long axis of the ski secures both portions of the ski against moving apart and thus separation. The latch is shifted towards the front portion of the ski. In another embodiment, for coupling with the omega arms facing the front of the ski, a role of a joint is played by the front of the binding attached by the screws directly to the arms of the coupling. In this embodiment, two latches have been used connecting the front and rear of the ski, shifted towards the front portion of the ski and located symmetrically against the long symmetry axis of the ski near the metal edges thereof. In both versions of the embodiment, a mortise is formed in the rear portion of the ski, which ensures a smooth flow of the snow when skiing on the snow. Both portions of the ski are joint by sliding the tenon of one portion of the ski into the mortise in the other portion of the ski. Then, the coupling is secured against unlocking, which may be provided by means of a ratchet, eccentric or clamp mechanism or by means of a cotter or cotter pin. In order to separate the ski, release the lock and move out the tenon from the mortise. After having moved the ski apart, it is preferable to secure both portions of the ski against complete separation by provisions of a line, belt or any other connector. Fasten both portions of the ski by standard bands. The ski is ready for transportation. The applied solution does not practically cause the weight of the ski to increase and has hardly any impact on the features of the ski, in particular the ski bend line when turning. It is applicable for all types of ski and majority of types of ski bindings.

A cascade coupling of an omega type allows extension of a ski coupling line, exceeding by multiples the width of the ski, which results in distribution of ski delaminating forces formed in the coupling when bending the ski, on a much greater distance. The maximum delaminating force is reduced by multiples compared with the ski with a coupling line equal the width of the ski.

The subject of the invention is shown in the embodiments in the drawing, where

Figure 2:
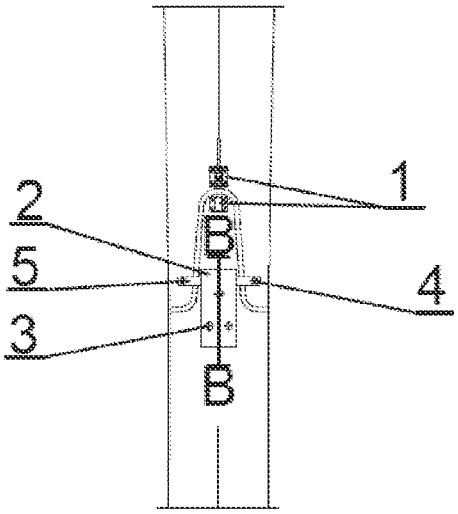
Figure 3:
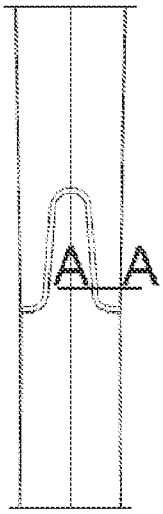
Figure 4:
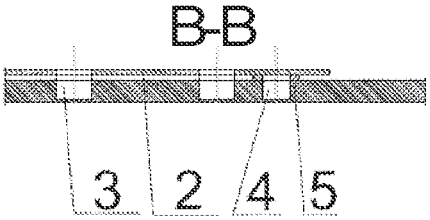
Figure 5:
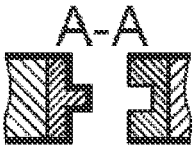
Figure 6:
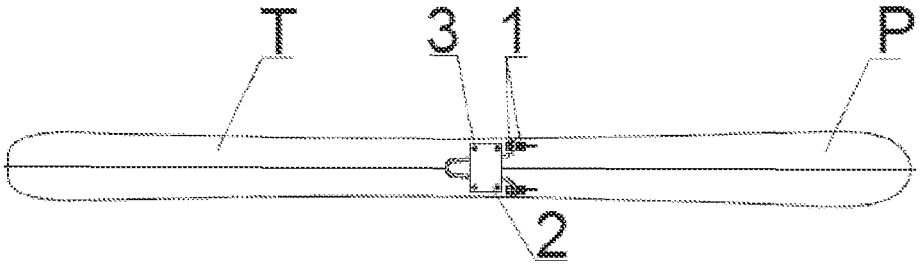
Figure 7:
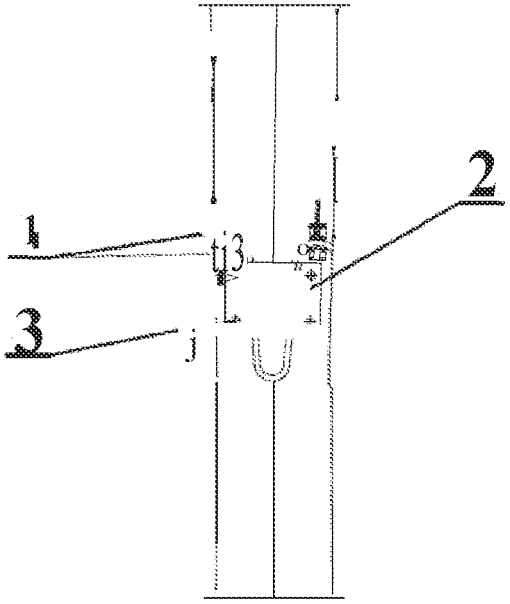
Figure 8:
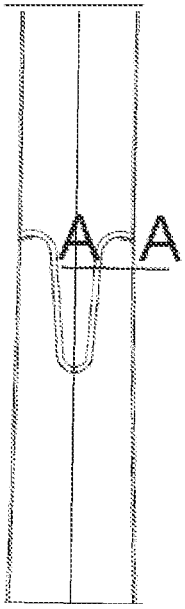
Figure 9:
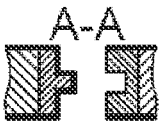
Figure 10:
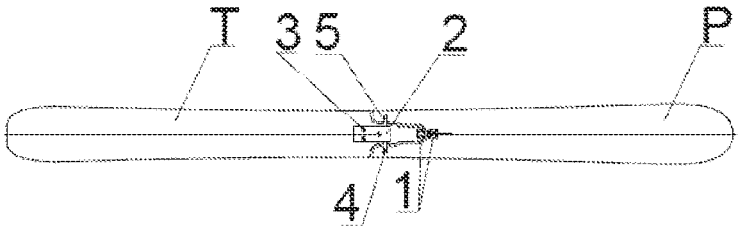
Figure 11:
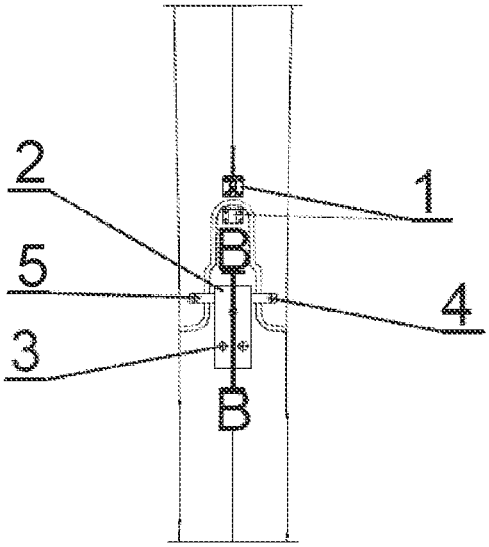
Figure 12:
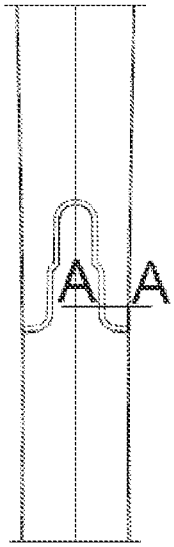
Figure 13:
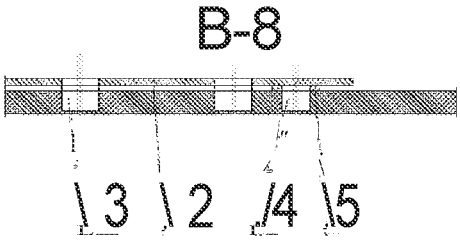
Figure 14:
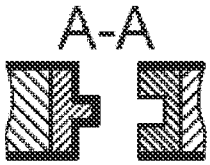
Figure 15:
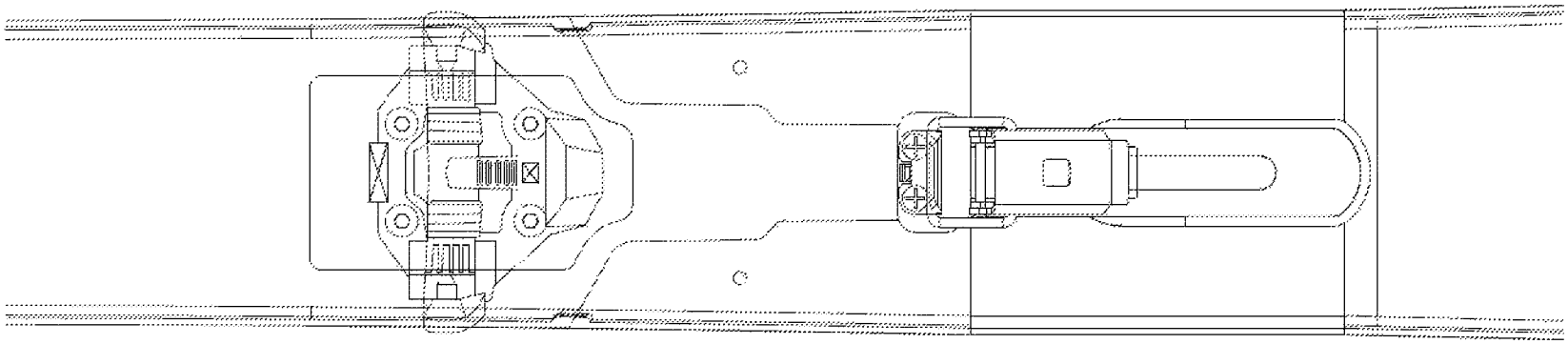

FIG. 1 shows a schematic top view of the collapsible ski ready to use,

FIG. 2 and FIG. 3 present the central part of the ski in the top view (FIG. 2) and from the sliding surface (FIG. 3), FIG. 4 shows arrangement of the openings for the fixing screws along the runner of the ski with the plate under the front of the binding, and FIG. 5 presents a transversal section of the ski in the place of the tenon and mortise joint, and then FIG. 6 shows a schematic top view of the collapsible ski ready to use in the embodiment with the omega arms towards the front of the ski, whereas FIG. 7 and FIG. 8 presents respectively the central portion of the ski in the top view (FIG. 7) and from the sliding surface (FIG. 8), and in FIG. 9 it is shown a transversal section of the ski in the point of the tenon and mortise joint. Then, FIG. 10 shows a schematic top view of the collapsible ski with the coupling in a form of a cascade of omegas, ready to use, FIG. 11 and FIG. 12 respectively show the central part of the ski in the top view (FIG. 11) and from the sliding surface (FIG. 12), FIG. 13 shows arrangement of the openings for the fixing screws along the runner of the ski with the plate under the front of the binding, and FIG. 14 presents a transversal section of the ski in the point of the tenon and mortise joint. A real view of the assembled ski, and prepared for assembly with the coupling in a shape of two omega letters (cascade), that is with the coupling half open, are presented respectively in FIG. 15 and FIG. 16.

Figure 17:
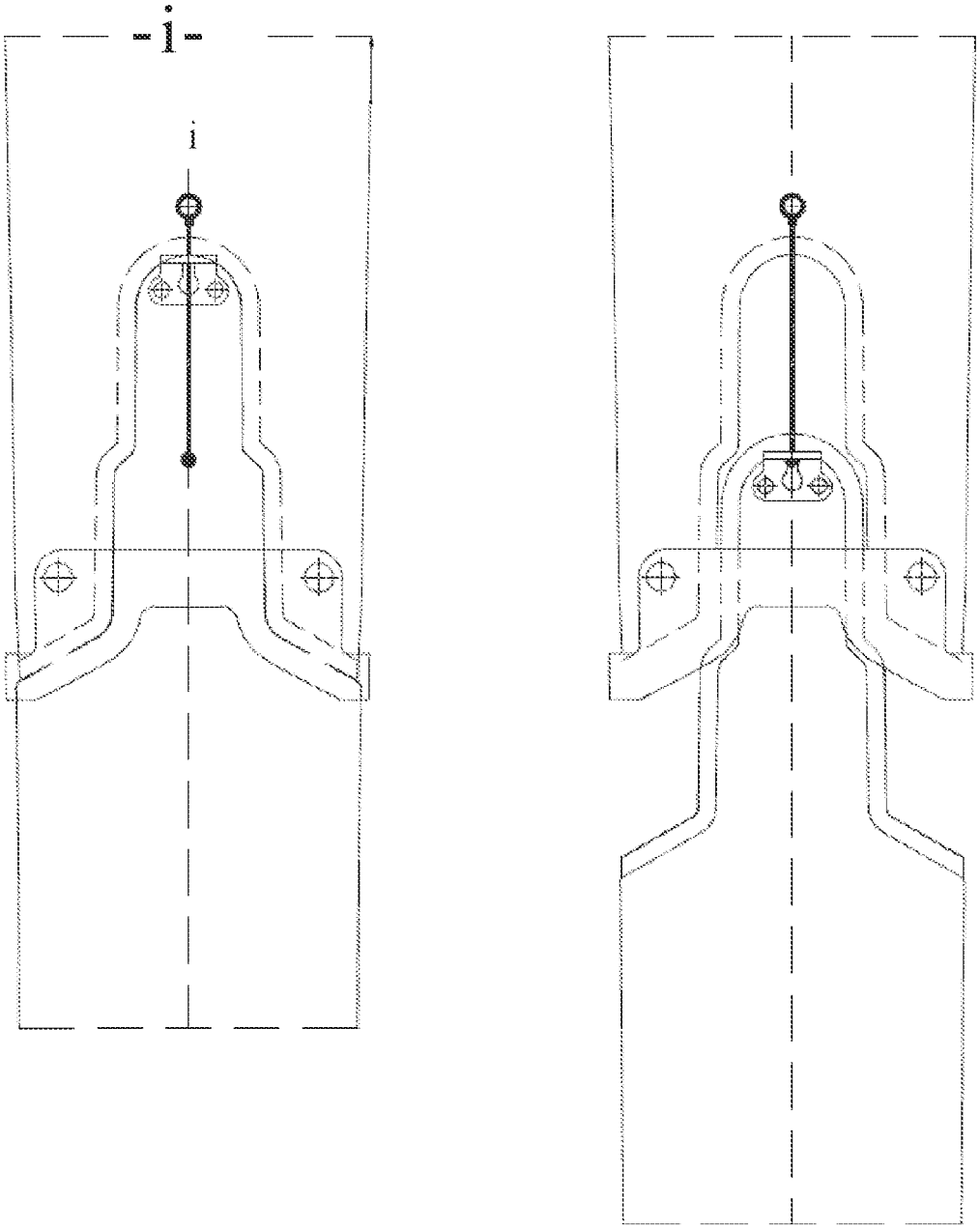

In FIG. 17 a view of the coupling is presented in enlargement.

As shown in the drawing, the ski according to the invention is detachable in the area of its midpoint, before the part where attached is the binding which front and rear should be mounted onto the rear portion of the ski, cut transversely from the edge to the edge. The cut is of a shape of a letter omega, whereas preferably the cut is of a shape of a cascade connection of omega letters, as illustrated in a drawing in FIG. 12. The entire width of the cut of the front portion of the ski is a mortise for a tenon formed by the cut line on the rear portion of the ski. The mortise and tenon are located in about a midpoint of the transverse section of the ski. The ski coupling is positioned in a location enabling assembly of the front of the binding to the rear portion of the ski. The arms of the coupling, resembling a shape of a letter omega, are interconnected to prevent moving the arms apart by the existing forces.

In the first embodiment, for the coupling with the omega arms facing the rear of the ski they are joint by a transversal bar 5, attached by screws 4 to the arms of the coupling, the bar is located just before the front part of the binding, whereas a situated in the long axis of the ski latch/clamp 1 secures both portions of the ski against moving apart and thus separation. The latch 1 is shifted towards the front portion of the ski. In this embodiment, the bar 5 is adjacent to the front of a plate 2 for the front of the binding, on the opposite end thereof there are located openings for screws 3 fixing the front of the binding to the rear portion of the ski. In another embodiment, for coupling with the omega arms facing the front of the ski, a role of a joint is played by the front of the binding 2, attached by the screws 3 directly to the arms of the coupling. In this embodiment, two latches have been used connecting the front and rear of the ski, shifted towards the front portion of the ski and located symmetrically against the long symmetry axis of the ski near the metal edges thereof. In both versions of the embodiment, a mortise is formed in the rear portion of the ski, which ensures a smooth flow of the snow when skiing on the snow. Both portions of the ski are joint by sliding the tenon of one portion of the ski into the mortise in the other portion of the ski.

Figure 16:
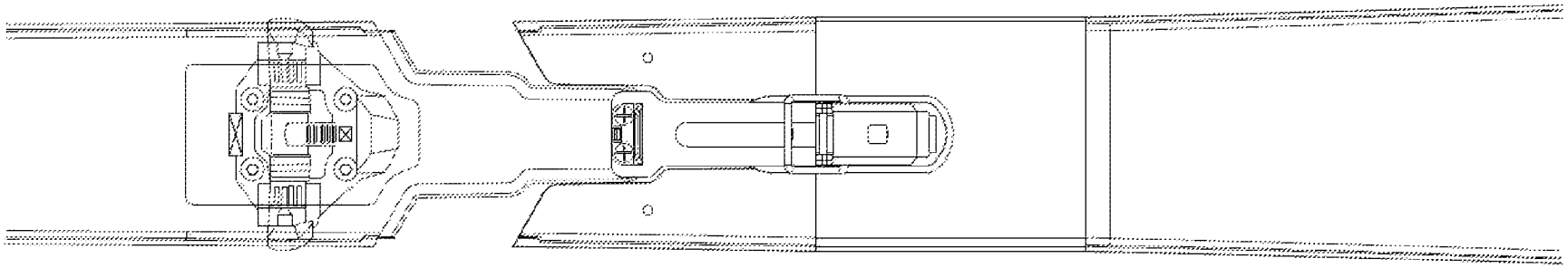

The use of the cut of the ski in a shape of a cascade connection of omega letters results in that moving such a coupling apart only half allows separation of the ski that in the case of a coupling in a shape of a single omega letter may be separated only after moving apart entirely, what is illustrated in the drawing in FIG. 16.

In the disclosed solution, the binding in whole is mounted to the rear half of the ski, which has no influence of the coupling on the security of the boot attachment to the ski. It allows using the majority of types of bindings available on the market. The continuity of the metal edge of the ski is interrupted on a very short distance, which has no influence on the edge grip in the conditions of hard and icy snow.

What is claimed is:

1. A ski collapsible for transportation, comprising in its assembled, i.e functional state:

- a front portion with a tip slightly bowed upwardly against the ground;
- a rear portion either typically flat or slightly away from a tail upwardly bent against the ground;
- a central area which is adapted for attachment of a ski binding consisting of a front part and a rear part and is suitable for mounting any ski boot on a top surface, wherein the front and rear portion of the ski are coupled together at the central area;
- wherein the front portion and the rear portion of the ski are coupled together by a coupling comprising provisions of:
  - a tenon formed in the rear portion of the ski along the entire width from the edge to the edge corresponding to a mortise formed on an entire width of the front portion of the ski, wherein the mortise comprises a pair of arms, wherein:
  - the coupling of the ski is positioned in a location enabling attachment of the front of the ski binding onto the rear portion of the ski;

the ski binding comprises:

a plate (2) coupled to the rear portion of the ski via screws (2); and a transversal bar (5) sandwiched between the plate (2) and the ski and disposed towards the front of the ski binding, wherein the transversal bar (5) is configured to couple the pair of arms of the mortise of the coupling resembling a shape of a letter omega; and a latch (1) located in a long axis of the ski and shifted towards the front portion of the ski securing both portions of the ski against moving apart and thus separation.

2. A ski collapsible for transportation, comprising in its assembled, i.e functional state:

a front portion with a tip slightly bowed upwardly against the ground;

a rear portion either typically flat or slightly away from a tail upwardly bent against the ground;

a central area which is adapted for attachment of a ski binding consisting of a front part and a rear part and is suitable for mounting any ski boot on a top surface, wherein the front and rear portion of the ski are coupled together at the central area;

wherein the front portion and the rear portion of the ski are coupled together by a coupling comprising provisions of:

a tenon formed in the rear portion of the ski along the entire width from the edge to the edge of the rear portion of the ski corresponding to a mortise formed on an entire width of the front portion of the ski, wherein the mortise comprises a pair of arms, wherein:

the coupling of the ski is positioned in a location enabling attachment of the front of the ski binding onto the rear portion of the ski;

the ski binding comprises:

a plate (2) coupled to the pair of arms of the mortise of the coupling resembling a shape of a letter omega via screws (3); and a pair of latches (1) shifted towards the front portion of the ski and located symmetrically against a long symmetry axis of the ski near the metal edges thereof, wherein the pair of latches is configured to couple the front and the rear portion of the ski.

3. The ski according to claim 1, characterized in that the front portion and the rear portion of the ski are coupled together by a flexible joint in a form of a cable, belt, or chain.

4. The ski according to claim 2, characterized in that the front portion and the rear portion of the ski are coupled together by a flexible joint in a form of a cable, belt, or chain.

* * * * *